US006845311B1

(12) United States Patent
Stratton et al.

(10) Patent No.: US 6,845,311 B1
(45) Date of Patent: Jan. 18, 2005

(54) SITE PROFILE BASED CONTROL SYSTEM AND METHOD FOR CONTROLLING A WORK IMPLEMENT

(75) Inventors: Kenneth Lee Stratton, Dunlap, IL (US); Daniel E. Henderson, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/701,273

(22) Filed: Nov. 4, 2003

(51) Int. Cl.[7] ..... E02F 3/76

(52) U.S. Cl. ..... 701/50; 37/348; 37/417; 340/870.16

(58) Field of Search ..... 701/50; 37/342, 37/348, 419, 414, 314, 319, 417, 907; 414/699; 172/4.5, 2

(56) References Cited

U.S. PATENT DOCUMENTS 4,491,927 A 1/1985 Bachmann et al.
4,775,940 A 10/1988 Nishida et al.
4,805,086 A 2/1989 Nielsen et al.
4,807,131 A 2/1989 Clegg
4,829,418 A 5/1989 Nielsen et al.
4,866,641 A 9/1989 Nielsen et al.
4,888,890 A 12/1989 Studebaker et al.
4,945,221 A 7/1990 Nielsen et al.
5,375,663 A 12/1994 Teach
5,438,771 A 8/1995 Sahm et al.
5,446,980 A 9/1995 Rocke
5,461,803 A 10/1995 Rocke
5,471,391 A 11/1995 Gudat et al.
5,493,494 A 2/1996 Henderson
5,493,798 A 2/1996 Rocke et al.
5,550,757 A 8/1996 Tervahauta
5,587,929 A 12/1996 League et al.
5,600,436 A 2/1997 Gudat
5,610,574 A 3/1997 Mutoh et al.
5,612,864 A 3/1997 Henderson
5,631,658 A 5/1997 Goudat et al.
5,646,844 A 7/1997 Goudat et al.
5,682,311 A 10/1997 Clark
5,682,312 A 10/1997 Rocke
5,735,352 A 4/1998 Henderson et al.
5,764,511 A 6/1998 Henderson
5,801,967 A 9/1998 Henderson et al.
5,815,826 A 9/1998 Henderson et al.
5,850,341 A 12/1998 Fournier et al.
5,854,988 A 12/1998 Davidson et al.
5,864,060 A 1/1999 Henderson et al.
5,912,512 A 6/1999 Hayashi et al.
5,925,085 A 7/1999 Kleimenhagen et al.
5,933,346 A 8/1999 Brabec et al.
5,935,192 A 8/1999 Henderson et al.
5,944,764 A 8/1999 Henderson et al.
5,964,298 A 10/1999 Greenspun
5,969,633 A 10/1999 Rosler
6,047,227 A 4/2000 Henderson et al.
6,061,617 A 5/2000 Berger et al.
6,073,068 A 6/2000 Koehrsen
6,076,029 A 6/2000 Watanabe et al.
6,085,583 A 7/2000 Cannon et al.

(List continued on next page.)

*Primary Examiner*—Thomas G. Black
*Assistant Examiner*—Tuan C To
(74) *Attorney, Agent, or Firm*—Howard & Howard

(57) ABSTRACT

An automatic control system for a work machine includes a positioning system, a site model, and a controller. The work machine operates at a work site containing material to be operated on by the work machine. The positioning system determines a relative location of the work machine within the work site and produces a machine position signal. The site model contains data related to a condition of the material. The controller is coupled to the site model, receives the machine position signal and determines a current condition of the material as a function of the position signal and the site model, and controls the work machine as a function of the current condition of the material.

43 Claims, 4 Drawing Sheets

U.S. PATENT DOCUMENTS 6,112,143 A 8/2000 Allen et al.
6,144,113 A 11/2000 Hayashi et al.
6,152,238 A 11/2000 Ferrell et al.
6,263,595 B1 7/2001 Ake
6,282,477 B1 8/2001 Gudat et al.
6,336,077 B1 1/2002 Boucher
6,345,231 B2 * 2/2002 Quincke ..... 701/213
6,364,028 B1 4/2002 Ferrell et al.
6,635,973 B1 * 10/2003 Kagoshima et al. ..... 307/10.1
2002/0162668 A1 * 11/2002 Carlson et al. ..... 172/4.5
2003/0144750 A1 * 7/2003 Watanabe et al. ..... 700/50

* cited by examiner

SITE PROFILE BASED CONTROL SYSTEM AND METHOD FOR CONTROLLING A WORK IMPLEMENT

DESCRIPTION

1. Technical Field

The present invention relates generally to an apparatus and method of controlling a work machine, and more particularly, to an apparatus and method for controlling a work machine as a function of material conditions.

2. Background

It is advantageous for a work implement of a work machine such as a track/wheel tractor to be operated in a manner that results in the greatest productivity. Often manual control of a work implement, such as a bulldozer blade, is inefficient, particularly over a period of time as the operator tires.

Maximum productivity can be achieved by maximizing the "draft power" of the work machine. Draft power is the rate of actual useful work being done in moving the soil and is defined as the product of the draft force of the work implement and the ground speed of the work machine.

In the example of a tractor, draft force is the force on the blade. Maximum draft power is reached when the tractor is moving at optimum ground speed commensurate with draft force. For typical tractor operation, a ground speed of 1.6 mph allows for optimum power and efficiency. Operators do not have direct ground, speed feedback and they cannot see the load on the blade. Accordingly, operators often control the tractor on their sense of slip and engine speed. The use of slip as a feedback mechanism is inefficient because slippage does not occur until productivity has already been lost. Operators that rely on their sense of slip feedback tend to run the tractor at a rate slower than that needed to achieve maximum power and efficiency. On the other hand, operators that rely on engine speed tend to run the tractor at a rate faster than that needed to achieve maximum power and efficiency.

Difficulties are often encountered in the control of the work implement when different ground profiles are encountered by the work machine. The work implement's position must be changed so that it will not dump its accumulated load nor cut too deeply, and still create a smooth cut. In addition, to maintain maximum efficiency, it is essential that the operator or the control system be able to differentiate between different ground profiles such as humps, rocks, and grade change.

Control systems have been developed that provide information for controlling the blade during various working conditions. However, the prior automatic control systems do not adequately control the blade position to achieve maximum efficiency in the variety of ground profiles encountered in operation. For example U.S. Pat. No. 4,630,685 by Huck et al. (the '685 patent), discloses an apparatus for controlling a work implement using angular velocity. The '685 patent is a relatively basic system in which ground speed and angular velocity directly control the actuator without an intervening loop on implement position. The lack of an implement position control loop and the reliance on angular velocity results in lower operating efficiency when the work machine encounters varying ground profiles.

Other automatic control systems also attempt to optimize machine performance. However, most of these systems rely on sensor information that is gathered as a cut is being made.

These systems may be adaptable to cut a variety of materials, however, they cannot automatically adapt to rapidly changing material properties. Highly skilled human operators adapt to rapidly changing material properties by noting the location of changing material properties during a cut and adjusting the load or machine prior to the change in material properties for the next cut.

Even highly skilled human operators may not adequately react to changing material conditions. For example, an area that is very hard to cut may be formed by any number of factors, e.g., blasting, non-uniform compaction, high traffic, and/or heavy loads. If a work machine that is heavily loaded enters an area with heavy or hard material, the operator must raise the blade to continue moving forward. This will cause a "hump" in the material to form that will result in lost efficiency.

The present invention is directed to overcoming one or more of the problems as set forth above.

SUMMARY OF THE INVENTION

In one aspect of the present invention, an automatic control system for a work machine is provided. The work machine operates at a work site containing material. The automatic control system includes a positioning system, a site model, and a controller. The positioning system determines a relative location of the work machine within the work site and produces a machine position signal. The site model contains data related to a condition of the material. The controller is coupled to the site model, receives the machine position signal and determines a current condition of the material as a function of the position signal and the site model, and controls the work machine as a function of the current condition of the material.

In another aspect of the present invention, an automatic control system for a work implement of a work machine is provided. The work machine operates at a work site containing material to be operated on by the work implement. The system includes a positioning system, a site model, a ground speed sensor, an angular rate sensor, a slip detector, an actuator, a position sensor, and a controller. The positioning system determines a relative location of the work machine within the work site and produces a position signal. The site model contains data related to a condition of the material. The ground speed sensor is coupled to the work machine for sensing a ground speed of the work machine and responsively generates a ground speed signal. The angular rate sensor senses an angular rate associated with the work machine and responsively generates an angular rate signal. The slip detector determines a slip rate value of the work machine and responsively generates a slip signal. The actuator is coupled to the work implement for controlling operation of the work implement. The position sensor is coupled to the actuator for sensing a position of the actuator and responsively generating an actuator position signal. The controller is coupled to the implement control system and the site model, receives the machine position signal and determines a current condition of the material as a function of the machine position signal and the site model and receives the actuator position signal and generates a control signal as a function of the actuator position signal and the current condition of the material. The implement control system receives the control signal and responsively controls the work implement.

In still another aspect of the present invention, a method for controlling a work machine is provided. The work machine operates at a work site containing material. The method includes the steps of determining a relative location of the work machine within the work site and producing a machine position signal, and determining a current condition of the material as a function of the machine position signal and a site model. The method further includes the step of controlling the work machine as a function of the current condition of the material.

DETAILED DESCRIPTION

Figure 1A:
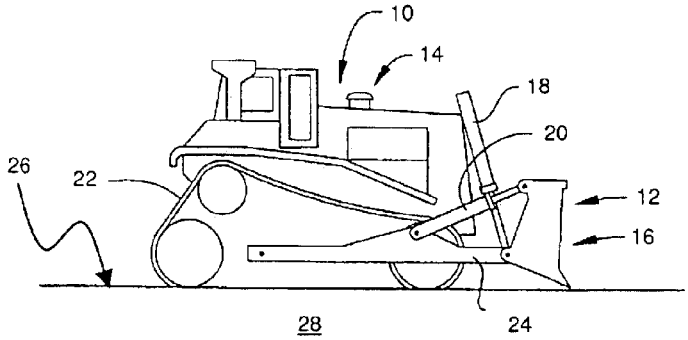
FIG. 1A is a diagram of a work machine.

With reference to the drawings, FIG. 1 shows a planar view of a work machine 10 having a work implement 12. For example, the work machine 10 may be an earthmoving machine and the work implement may be work implement 12 utilized to move earth or soil.

For illustrative purposes the work machine 10 shown is a track-type tractor 14 and the work implement 12 shown is a bulldozer blade or bulldozer 16. While the invention is described using the tractor 14 and the bulldozer blade 16, it is intended that the invention also be used on other types of work machines 10 and work implements 12 such as construction or agricultural machines and earthmoving machines, e.g., a wheel loader or a track loader. The tractor 14 includes hydraulic lift actuators 18 for raising and lowering the blade 16 and hydraulic tilt actuators 20. Although not shown in FIG. 1, the tractor 14 preferably includes two lift actuators 18 and two tilt actuators 20, one on each side of the bulldozer blade 16. As shown in FIG. 1, the tractor 14 includes a set of tracks 22 and a draft arm 24 to push the blade 16.

Power applied to the blade 16 via the hydraulic lift cylinders 18 during earthmoving operations causes the blade 16 to push and carry the soil. Maximum productivity and efficiency is achieved by maintaining maximum power on the blade 16. Power in such a context is generally known as draft or blade power. Blade power is a measure of the rate of actual useful work being done in moving the soil and can be expressed as follows:

$P=F\times V$, where P=Blade Power, F=Blade Force, and V=Ground Speed.

Figure 2:
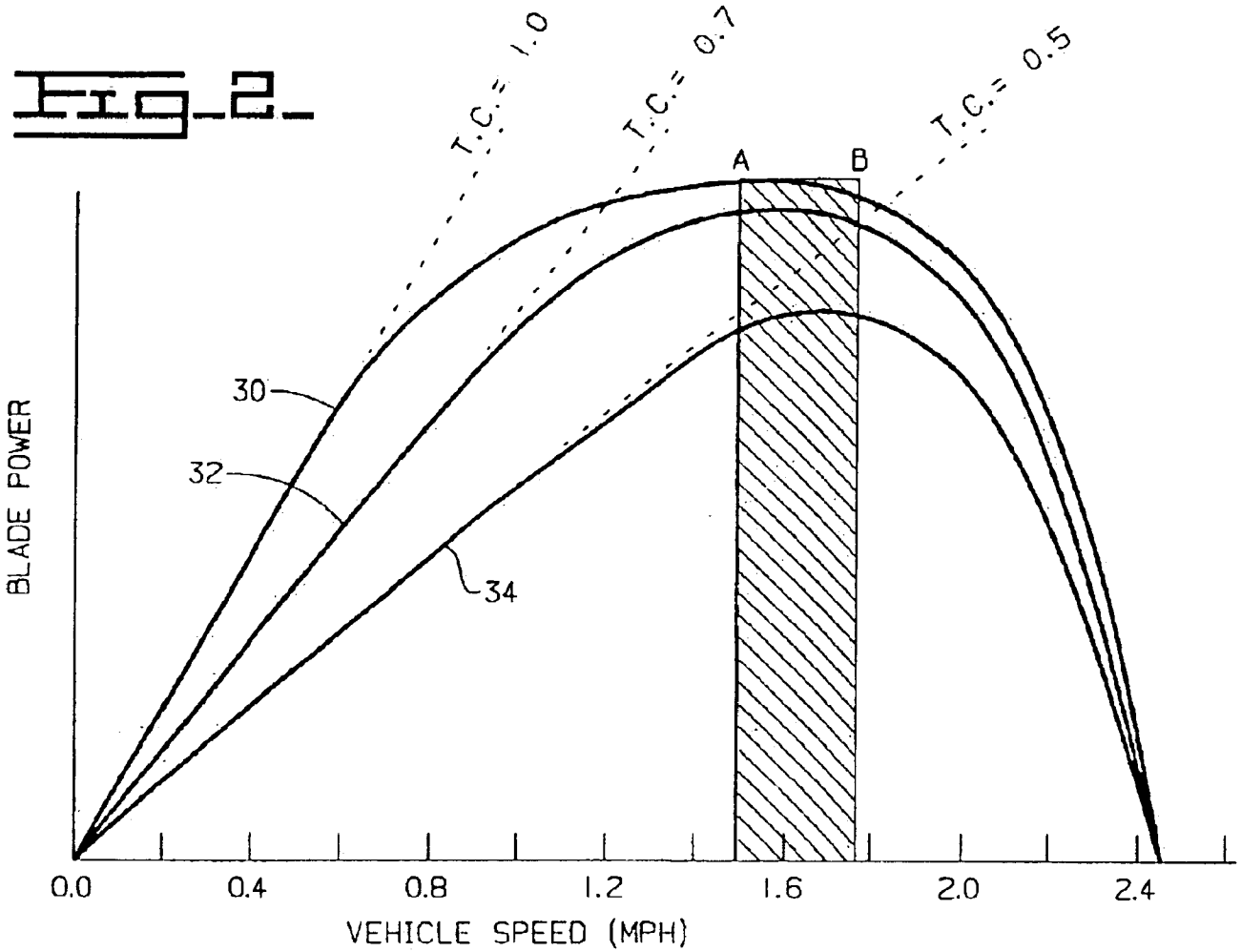
FIG. 2 is a graphic representation of ground speed versus implement power.

The relationship between ground speed of the tractor 14 relative to the ground and the blade power is shown in FIG. 2 for different traction coefficients. Traction coefficients vary according to ground materials and conditions.

A first power curve 30 is shown in FIG. 2 and corresponds to a traction coefficient of 1. However, a traction coefficient of 1 is almost never realized in actual operation. Second and third power curves 32,34 correspond to traction coefficients of 0.7 and 0.5 respectively. In most applications, including mining applications, the traction coefficient is typically in the range between 0.5 and 0.7. Maximum forward power productivity is achieved when the tractor 14 is operated at the peaks of the power curves 30, 32, 34. Blade power is maximum between states "A" and "B" for all of the depicted power curves 30, 32, 34. As shown in FIG. 2, a vehicle ground speed of approximately 1.6 MPH delivers the desired blade power between states "A" and "B".

Figure 1B:
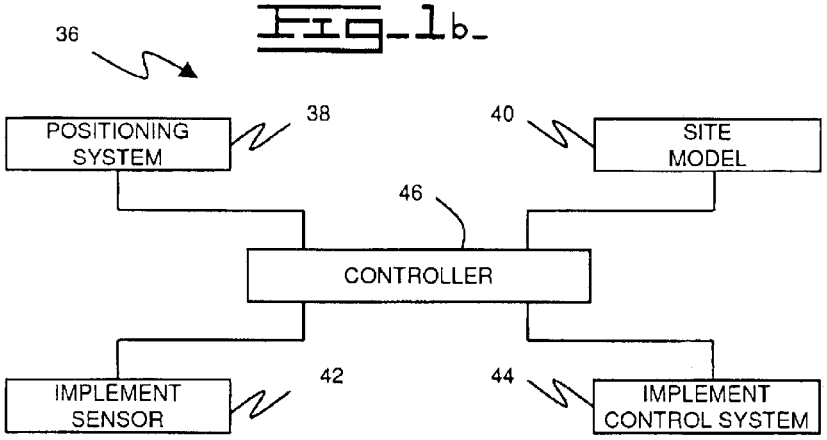
FIG. 1B is a block diagram of the automatic control system for the work implement of the work machine, according to an embodiment of the present invention.

With specific reference to FIG. 1B, an embodiment of the present invention provides an automatic control system 36 for the work implement 12 of the work machine 10. The work machine may be for operating at a work site 26 (see FIG. 1). The work site 26 contains material 28 to be operated on by the work implement 12.

The automatic control system 36 includes a positioning system 38, a site model 40, at least one implement sensor 42, an implement control system 44, and a controller 46.

The positioning system 38 determines a relative location of the work machine 10 within the work site 26 and produces a machine position signal. The positioning system 38 may include a GPS receiver and/or laser positioning system. Such receivers and systems are well-known in the art and are therefore not further discussed.

The site model 40 contains data related to a condition of the material 28. In one embodiment, the data related to a condition of the material 28 stored and contained in the site model is related to traction of the work machine 10. For example, the data related to a condition of the material 28 stored in the site model 40 may include a traction coefficient. In another embodiment the data related to a condition of the material may be related to a hardening of the material.

In one aspect of the present invention, the automatic control system 36 controller 46 is coupled to the site model 40 for receiving the machine position signal and determining a current condition of the material 28 as a function of the position signal and the site model 40. The controller generates a control signal as a function of the current condition of the material 28 and responsively controls the work machine as a function of the control signal.

In another aspect of the present invention, the controller 46 is coupled to the implement control system 44 and the site model 40. The controller 46 receives the machine position signal and determines a current condition of the material 28 as a function of the machine position signal and the site model 40. The controller 46 receives the implement position signal and generates a control signal as a function of the implement position signal and the current condition of the material 28. The implement control system 44 receives the control signal and responsively controls the work implement 44.

The traction coefficient is a mathematical term that describes a material's ability to support traction or pull. For example, sandy ground provides poor traction, and has a low traction coefficient. Conversely, strong material with good traction (such as most clay materials) has a high traction coefficient. The higher the traction coefficient, the higher the pulling force a machine may exert. Additionally, in most ground conditions, a heavier machine will pull more, i.e., have a higher pulling force. The traction coefficient may be expressed as:

T.C.=Max_Drawbar_Pull/Weight.

In one embodiment of the present invention, the site model 40 may be either a two-dimensional or three-dimensional database which includes traction coefficient data as well as other data, such as actual and desired site profile data regarding locations within the work site 26. For example, the data in the site model may be used to indicate how the traction coefficient changes throughout the work site 26. Both the site profile data and the traction coefficient data may be updated in real-time, based on position information from the positioning system 38 and/or other sensor data. For example, the automatic control system 36 may include a slip detector 52 for detecting the amount of slip encountered by the tracks 22 of the tractor 14 and responsively generating a slip signal. The controller 46 may utilize the slip signal to determine an actual traction coefficient as a function of the slip signal and update the site model 40 in real-time. One suitable dynamic site model or database is disclosed in U.S. Pat. No. 5,493,494 which is hereby incorporated by reference.

The at least one implement sensor 42 (see below) senses a parameter of the work implement 12 and produces at least one implement signal.

The implement control system 44 is coupled to the work implement 12 and controls operation of the work implement.

The controller 46 is coupled to the implement control system 44 and the site model 40. The controller 46 receives the machine position signal and determines a current condition of the material 28 as a function of the position signal and the site model 40. The controller 46 further receives the at least one implement signal and generates a control signal as a function of the at least one implement signal and the current condition of the material 28. The implement control system 44 receives the control signal and responsively controls the work implement 12.

As discussed above, in one embodiment, the site model 40 includes a ground profile. The ground profile is indicative of the contours of the ground previously traversed by the work machine 10.

In one embodiment, the control signal is further determined as a function of the ground profile.

Figure 3:
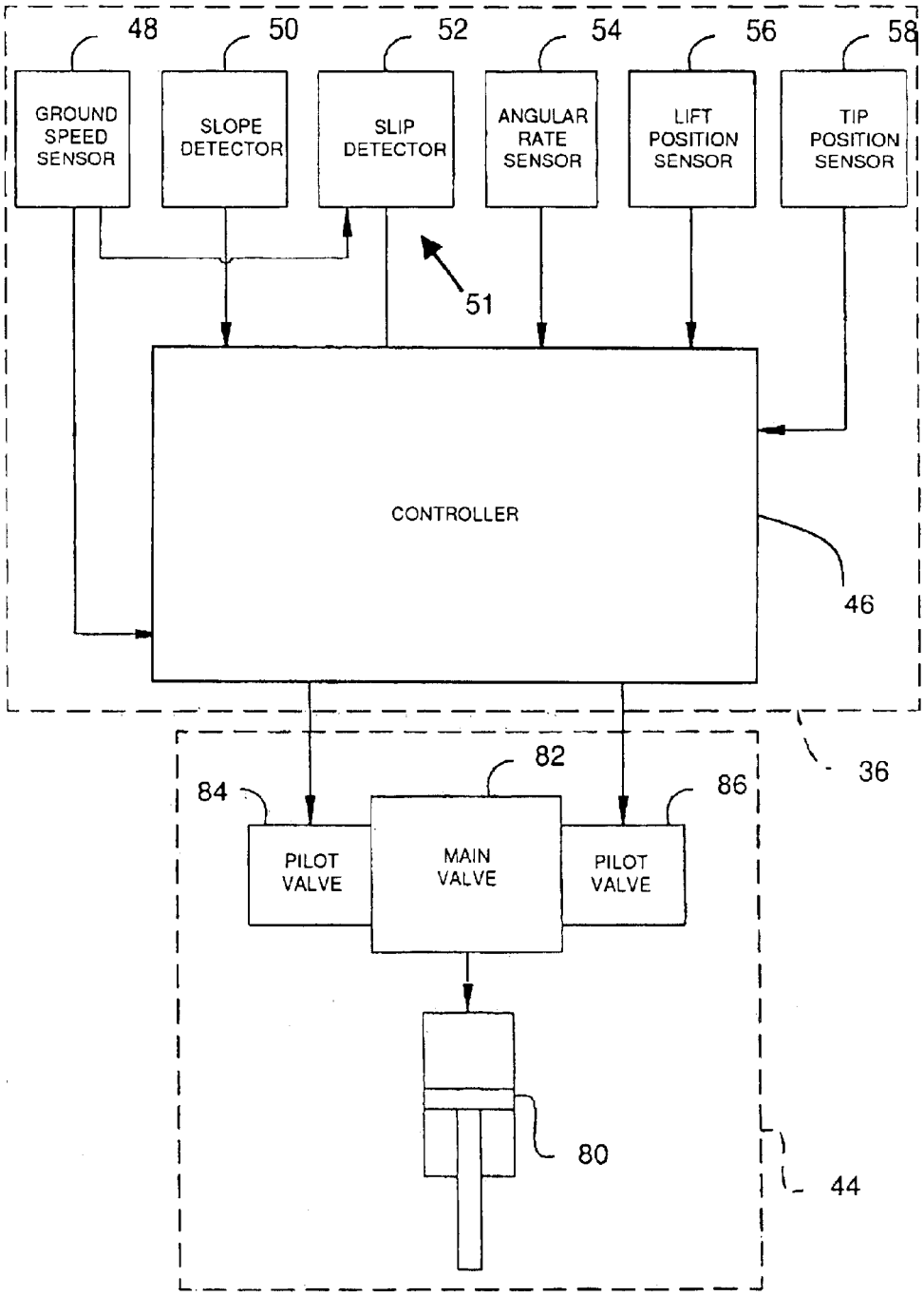
FIG. 3 is a more detailed block diagram of the automatic control system for the work implement of the work machine of FIG. 1B.

FIG. 3 shows a block diagram of an automatic control system 36 for the work implement 12 of the work machine 10. The automatic control system 36 is adapted to control the lift actuator 18. For the purposes of illustration, the lift actuator 18 depicted in the block diagram of FIG. 3 is shown as a single hydraulic lift cylinder 80 with a single main valve 82 and two pilot valves 84,86. In one embodiment, the automatic control system 36 includes a ground speed sensor 48, a slope detector 50, the slip detector 52, an angular rate sensor 54, lift position sensor 56, and a tip position sensor 58.

The ground speed sensor 48 is coupled to the work machine, senses a ground speed of the work machine, and responsively generates a ground speed signal. The ground speed sensor 48 senses the true ground speed "V" of the work machine 10 and responsively produces a ground speed signal. The ground speed sensor 48 is suitably positioned on the tractor 14 and includes, for example, a non-contacting ultrasonic or Doppler radar type sensor.

The angular rate sensor 54 senses an angular rate associated with the work machine 10, e.g., for detecting a pitch rate of the work machine 10, and responsively generates an angular rate signal. The angular rate sensor is suitably positioned on the tractor 14 and includes, for example, a gyroscope. A quartz-gyro chip manufactured by Systron and Donner is suitable for this application.

The system 36 may also include a sensor 51 for detecting an actual condition of the material. The controller 46 may update the site model 40 as a function of the actual condition. In one embodiment, the sensor 51 includes the slip detector 52. The slip detector 52 determines a slip rate value of the work machine or the amount of slip encountered by the tracks 22 and responsively generates the slip signal. In one embodiment, the slip detector 52 receives the ground speed signal from the ground speed sensor 42 and calculates the amount of slip by utilizing the ground speed with, for example, the output speed of a torque converter, sprocket speed, and gear selection. Algorithms for the determination of amount of slip are well known in the art and will not be discussed in greater detail.

In one embodiment, the controller 46 determines an expected path of the work machine 10 as a function of the position signal by evaluating the position signal over a period of time and extrapolating the expected path. The control signal may be determined as a function of the expected path.

The position sensor 56 senses a position of the lift actuator and responsively generates a lift actuator position signal. In one embodiment, the lift position sensor 56 is suitably positioned on the lift actuators 18. There are several known linear position sensing devices that measure absolute position and can be used in connection with the cylinders of the lift actuators 18. For example, RF (radio frequency) sensors, LVDT (linear variable differential transformer), or magnerestrictive sensors are well known and suitable. In addition, the lift position sensor 56 could be replaced by a device that measures the position of the work implement 12 relative to the work machine 10 such as a radar or laser system.

The controller 46 receives the slip signal, the angular rate signal, the ground speed signal, and the lift actuator position signal and responsively determines an implement position as a function of the slip signal, the angular rate signal and the lift actuator position signal.

The control signal (see above) is a function of the implement position, the slip signal, and the ground speed signal. In one embodiment, the control signal is further determined as a function of a predetermined desired ground speed. In one embodiment, the predetermined desired ground speed is determined to achieve maximum forward power productivity.

In another aspect of the present invention, a method controls a work implement of a work machine. The work machine 10 operates at a work site 26 containing material 28 to be operated on by the work implement 12. The work implement 12 is controlled by an implement control system 44.

The method includes the steps of determining a relative location of the work machine 10 within the work site 26 and producing a machine position signal, and receiving the machine position signal and determining a current condition of the material 28 as a function of the position signal and a site model 40. The site model contains data related to a condition of the material.

The method also includes the step of controlling the work machine 10 as a function of the current condition.

The automatic control system 40 may also include a slope detector 44 for determining the slope or inclination upon which the tractor 14 is operating. The slope detector 44 produces a slope signal. In the one embodiment, the slope detector 44 includes an inclination sensor, such as a gyroscope, and/or an angular rate sensor, in conjunction with a Kalman filter which provides optimum performance in both steady state and dynamic applications. A slope detector sensor utilizing capacitive or resistive fluids may also be used. Other inputs to the Kalman filter may include the actual ground speed of the work machine 10. One such device for detecting slope of a machine is disclosed in U.S. Pat. No. 5,860,480 issued Jan. 19, 1999, which is hereby incorporated by reference.

A tip position sensor 58 senses the tilt of the blade 16 and produces a tip position signal. A relative position of the blade 16 may be calculated as a function of the amount of hydraulic fluid entering the cylinders of the hydraulic tilt actuators 20, which is a function of the flow rate of hydraulic fluid and the time over which fluid enters the cylinders of the hydraulic tilt actuators 20. The tip position sensor 58 and associated method is described in greater detail in U.S. Pat. No. 5,467,829, issued Nov. 21, 1995 and entitled "Automatic Lift And Tilt Coordination Control System And Method Of Using Same" which is herein incorporated by reference.

In one embodiment, the controller 46 receives the slip signal from the slip detector 52, the angular rate signal from the inclination sensor and/or angular rate sensor 54, the lift position signal from the lift position sensor 56, and the tip position signal from the tip position sensor 58. In another embodiment, which will be described in greater detail hereafter, controller 46 does not utilize the tip position signal from the tip position sensor 58.

The controller 46 uses the above identified signals to calculate the height of the blade 16 as a function of, for example, three terms. The first blade height term is primarily a function of the angular rate signal. The angular rate signal can be integrated to derive a change in the pitch angle Θ and the pitch angle Θ itself.

Figure 4A:
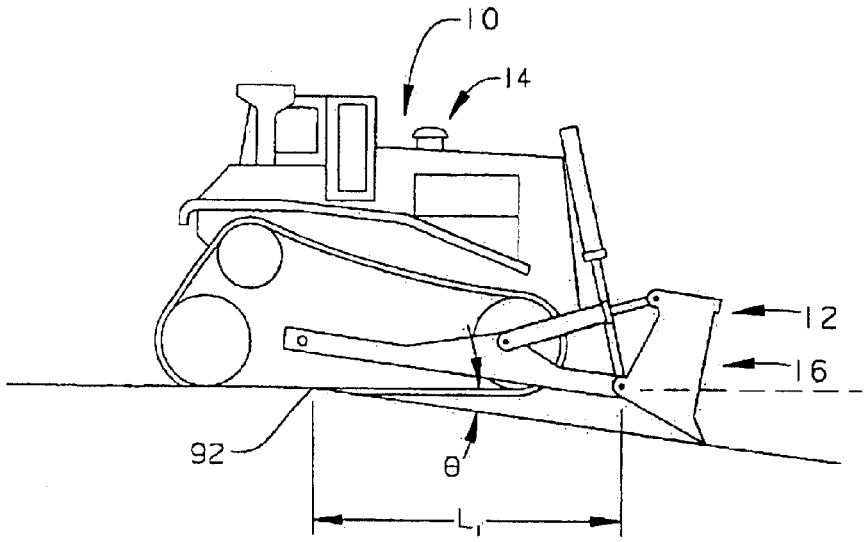
FIG. 4A is a side view of the work machine pitching forward during a cut; and, FIG. 4B is a side view of the work machine pitching aft during a cut.

Referring now to FIG. 4A, the tractor 14 and the blade 16 are shown pitching forward into the cut from the top. As this forward pitch occurs, the blade 16 cuts deeper into the soil. The pitch angle Θ is shown in FIG. 4A. In addition, as illustrated in FIG. 4A, the forward pitch axis 92 is approximately the COG (center of gravity) of the tractor 14 and the distance from the forward pitch axis 92 to the blade 16 is identified as "L1".

Figure 4B:
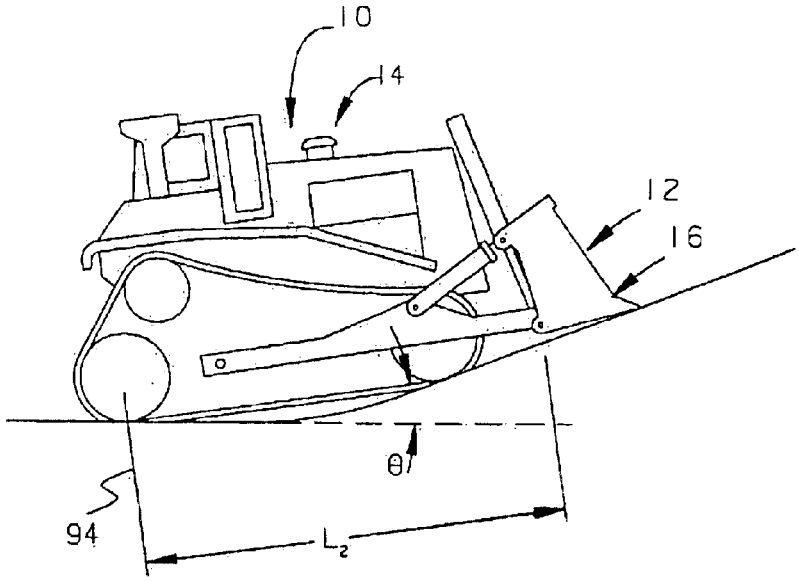

Likewise, in FIG. 4B, the tractor 14 and the blade 16 are shown pitching backward or aft, and the blade 16 tends to move out of the soil. The pitch angle Θ is shown in FIG. 4B. In addition, as depicted in FIG. 4B, the distance from an aft pitch axis 94 to the blade 16 is identified as "L2".

The controller 46 calculates the first term of the blade height position (PIT_TM) according to the following equation:

$$PIT_TM = K1 \int PA(t)\Theta dt$$

where:

K1=Distance from either the rear idler (L1) or the COG (L2) to the blade (in mm)*0.01745 rad/deg PA=Pitch Axis (L1 or L2, if forward or backward pitch, respectively)

Θ=Pitch Angle

In another aspect of the present invention, the pitch angle is filtered using a Kalman filter (resulting in a distance filtered pitch angle) to determine if the pitch angle of is causing the work implement 12 to cut deeper or if the work machine is rotating while the work implement 12 retains its position with respect to the material 28. For example, if the lift actuators 18 are being actuated to move the work implement 12, the work implement 12 may either dig deeper into the material 28 and/or remain constant with respect to the material 28, while the work machine 10 rotates about COG. If the pitch angle is greater than the distance filtered pitch angle, then K1 is a constant value associated with the rear idler distance (L1). Otherwise K1 is a constant value associated with the COG distance (L2). In addition, if K1 is a constant associated with the rear idler, the constant is altered as a function of slip in accordance with a look-up table. The purpose of altering the K1 value as a function of the slip signal when the aft pitch axis 94 is utilized is to account for sinkage caused by the track slip. The look-up table decreases the value of K1 as the slip increases.

The second blade height term (LFT_TM) is primarily a function of the lift position signal produced by the lift position sensor 56. In one embodiment, the controller 46 calculates the second term of the blade height position according to the following formula:

$$LFT_TM = L2 * \text{Lift Position}$$

The term K2 is a constant based on the geometry of the cylinder to account for the angle at which the lift actuator 18 is positioned with respect to the tractor 14.

The third blade height term (TIP_TM) is primarily a function of the tip position signal produced by the tip position sensor 58. The controller 46 calculates the pitch angle of the blade from the tip position signal and calculates the third term of the blade height position according to the following formula:

$$TIP_TM = K3 * \text{Pitch Angle of Blade}$$

The term K3 is a constant based upon the geometry of the blade 16 and the lift and tilt actuators 18,20. The controller 46 sums the three blade height terms (PIT_TM+LFT+_TM+TIP_TM) to derive the implement position signal (IP_REF). The controller 46 may also sum only the first two terms (PIT_TM+LFT_TM) to derive the implement position signal (IP_REF).

The controller 46 may also adjust a predetermined desired ground speed setting. In one embodiment, the operator may adjust the desired ground speed setting. Under normal conditions, the desired ground speed setting may be 1.6 MPH as depicted in FIG. 2. The controller 46 may adjust the desired ground speed as a function of the slope signal produced by the slope detector 50 and produce an adjusted ground speed reference signal. The adjustment is accomplished by use of look-up tables that correlate various slope values with ground speed values. For example, for a 20% grade, the desired speed may be down to 1.4 MPH. This feature maintains the blade load as the slope of the ground changes. Such a change in adjustment may optimize productivity on varying grades.

In another embodiment, the desired ground speed may be adjusted in response the condition of the material 28. For example, if the work machine 10 is entering a section of material having a lower traction coefficient the desired ground speed could be increased to reduce the load prior to entering this area.

The automatic control system 36 may also calculate a change in the position of the blade 16 and issue a lift actuator command signal to control the hydraulic lift actuators 18. The controller 46 receives the ground speed signal from the ground speed sensor 48, the adjusted ground speed reference signal, the slip signal from the slip detector 52, and the implement position signal.

In one embodiment, the controller 46 calculates and determines the proper lift actuator command signal in two stages. In the first stage, a desired implement position term is calculated as a function of four basic values. The first value (IP_REF) is the implement position as delivered by the implement position signal.

The second value used in the first stage of the calculation process is a slip error value (SLP_ERR). The slip error value is derived from the slip signal. The controller 46 calculates the slip error value according to the following formula:

$$SLP_ERR = K4 \int (SV - (0.0165))\Delta x$$

where:

K4=Stability Constant

SV=Slip Value

Δx=Change in Distance

If SLP_ERR<0, then SLP_ERR=previous SLP_ERR

K4 is a predetermined constant that is based on stability criteria. The use of such a constant is known by those skilled in the art.

In one embodiment, an additional proportional term may be added to the slip error value. The additional proportional term may be in the form of: K4'(SV−0.0165), where K4' is a constant.

The third value used in the first stage of the calculation process is a speed error value (SPD_ERR). The speed error value is derived from the ground speed signal and adjusted ground speed reference signal. The controller 46 calculates the speed error value according to the following formula:

$$SPD_ERR=K5\int(SPEED-SPEEDREF)\Delta x$$

where:

K5=Stability Constant

SPEED=Ground Speed

SPEEDREF=Adjusted Speed Reference Signal

Δx=Change in Distance. K5 is a predetermined constant that is based on stability criteria. The use of such a constant is known by those skilled in the art.

The slip error value (SLP_ERR) and the speed error value (SPD_ERR) may be limited to certain percentage changes to avoid stability problems. For example, when the blade is lowering into the ground, the percent change allowed is 6%. When raising the blade, the percent change allowed is 20%.

The fourth value used in the first stage of the calculation process is a proportional speed value (PRO_SPD). The proportional speed value is derived from the ground speed signal and adjusted ground speed reference signal. The controller 46 calculates the proportional speed value according to the following formula:

$$PRO_SPD=K6(SPEED-SPEEDREF)$$

where:

K6=A Constant

SPEED=Ground Speed

SPEEDREF=Adjusted Speed Reference Signal

K6 is a predetermined constant. The proportional speed value allows the blade to adjust to rocks encountered in the soil compared to slope changes because it is based solely on ground speed change.

The first stage results in the computation of a desired implement position value (IP_DES) by summing the four terms: initial implement position, slip error value, speed error value, and proportional speed value:

$$IP_DES=IP_REF+SLP_ERR+SPD_ERR+PRO_SPD$$

In the second stage, a lift actuator command signal (LFT_CMD) is produced as a function of the desired implement position term (IP_DES) computed in the first stage and the implement position signal (IP_REF) produced by the implement sensor 42. The lift actuator command signal is derived from the difference between the desired implement position term and the implement position signal (IP_ERR) in the following manner:

$$IP_ERR=IP_DES-IP_REF$$

$$LFT_CMD=K7(TQ,PR)*IP_ERR+K8(TW,PR)*d(IP_ERR)/dx$$

The terms K7(TQ,PR) and KS(TQ,PR) are derived from lookup tables that vary in accordance with torque and pitch rate so that when there is a small blade load, the gain value of the terms is reduced to increase stability. The use of such constants are known in the art. The lift actuator command signal (LFT_CMD) controls the work implement 12.

As adjustments are made to the work implement 12, the ground profile in the site model 40 may be updated. The ground profile is a map of the contours of the ground covered by the work machine 10. When the work machine 10 traverses the same route, the stored ground profile (GND_HT) would be delivered to the controller 46 and used in the calculation of the desired implement position term (IP_DES) in the following manner:

$$IP_DES=IP_REF+SLP_ERR+SPD_ERR+PRO_SPD+K\Delta GND_HT$$

The ground profile term, KΔGND_HT, includes a predetermined constant multiplied by the change in ground height from the ground profile. The term provides a feed-forward element to allow the work implement 12 to adjust in accordance with upcoming changes in the ground profile.

Industrial Applicability

The automatic control system 36 is advantageously used in construction equipment such as wheel and track/type tractors. It can be appreciated that by using the present invention, a tractor can operate in the most productive mode. Stable implement control is maintained over all ground profiles encountered by the work machine 10. Productivity is substantially enhanced by automatically controlling the work implement 12 in response to sensed variables directly related to blade power.

Other aspects, objects, and advantages of this invention can be obtained from a study of the drawings, the disclosure, and the appended claims.

What is claimed is:

1. An automatic control system for a work machine for operating at a work site, the work site containing material to be operated on by the work machine, comprising:

a positioning system operable to determine a relative location of the work machine within the work site and produce a machine position signal;

a site model containing data related to a condition of the material; and, a controller being coupled to the site model operable to receive the machine position signal and determine a current condition of the material as a function of the position signal and the site model, operable to generate a control signal as a function of the current condition of the material and operable to responsively control the work machine as a function of the control signal.

2. An automatic control system, as set forth in claim 1, the work machine has a work implement, the automatic control system further comprising:

at least one implement sensor operable to sense a parameter of the work implement and produce at least one implement signal; and an implement control system coupled to the work implement operable to control operation of the work implement, the controller operable to receive the at least one implement signal, the control signal being a function of the current condition of the material and the at least one implement signal, the implement control system operable to receive the control signal and responsively control the work implement.

3. An automatic control system, as set forth in claim 1, wherein the data related to a condition of the material stored and contained in the site model is related to traction of the work machine.

4. An automatic control system, as set forth in claim 3, wherein the data related to a condition of the material includes a traction coefficient.

5. An automatic control system, as set forth in claim 4, further comprising a slip detector operable to determine a slip rate value of the work machine and to responsively generate a slip signal, the controller operable to receive the slip signal and determine an actual traction coefficient and operable to update the site model as a function of the actual traction coefficient.

6. An automatic control system, as set forth in claim 1, wherein the positioning system includes a GPS receiver.

7. An automatic control system, as set forth in claim 1, wherein the positioning system includes a laser system.

8. An automatic control system, as set forth in claim 1, the site model including a ground profile, the ground profile being indicative of the contours of the ground previously traversed by the work machine.

9. An automatic control system, as set forth in claim 8, wherein the control signal is further generated as a function of the ground profile.

10. An automatic control system, as set forth in claim 2, wherein the implement control system includes a lift actuator associated with the work implement.

11. An automatic control system, as set forth in claim 10, further comprising:

a ground speed sensor coupled to the work machine operable to sense a ground speed of the work machine and to responsively generate a ground speed signal;

an angular rate sensor operable to sense an angular rate associated with the work machine and to responsively generate an angular rate signal;

a slip detector operable to determine a slip rate value of the work machine and to responsively generate a slip signal; and, the at least one implement sensor including a position sensor operable to sense a position of the lift actuator and to responsively generate a lift actuator position signal, the controller operable to receive the slip signal, the angular rate signal, the ground speed signal, and the lift actuator position signal and to responsively determine an implement position as a function of the slip signal, the angular rate signal and the lift actuator position signal, the control signal being generated as a function of the implement position, the slip signal, and the ground speed signal.

12. An automatic control system, as set forth in claim 1, wherein the control signal is further generated as a function of a predetermined desired ground speed.

13. An automatic control system, as set forth in claim 1, further comprising a sensor operable to detect an actual condition of the material, the controller being operable to update the site model as a function of the actual condition of the material.

14. An automatic control system, as set forth in claim 1, the controller being operable to determine an expected path of the work machine as a function of the position signal, the control signal being generated as a function of the expected path.

15. An automatic control system, as set forth in claim 1, where the date related to a condition of the material is related to hardness of the material.

16. An automatic control system, as set forth in claim 1, the controller being operable to modify a speed of the work machine as a function of the condition of the material.

17. An automatic control system, as set forth in claim 2, the controller being operable to modify a speed of the work machine as a function of the condition of the material by actuating the work implement.

18. An automatic control system, for a work implement of a work machine, the work machine for operating at a work site, the work site containing material to be operated on by the work implement, comprising:

a positioning system operable to determine a relative location of the work machine within the work site and to produce a position signal;

a site model containing data related to a condition of the material;

a ground speed sensor coupled to the work machine operable to sense a ground speed of the work machine and responsively generate a ground speed signal;

a slope detector operable to determine a slope of the work machine and responsively generate a slope signal;

a slip detector operable to determine a slip rate value of the work machine and responsively generate a slip signal;

an actuator coupled to the work implement operable to control operation of the work implement;

a position sensor coupled to the work implement operable to sense a position of the work implement and responsively generate an implement position signal;

a controller being coupled to the implement control system and the site model, the controller being operable to receive the machine position signal and determine a current condition of the material as a function of the machine position signal and the site model and being operable to receive the slope signal, the slip signal, and the implement position signal and generate a control signal as a function of the slope signal, the slip signal, the implement position signal and the current condition of the material, the implement control system being operable to receive the control signal and responsively control the work implement.

19. An automatic control system, as set forth in claim 18, wherein the data related to a condition of the material stored and contained in the site model is related to traction of the work machine.

20. An automatic control system, as set forth in claim 16, wherein the data related to a condition of the material includes a traction coefficient.

21. An automatic control system, as set forth in claim 17, the controller being operable to receive the slip signal and determine an actual traction coefficient and operable to update the site model as a function of the actual traction coefficient.

22. An automatic control system, as set forth in claim 15, the site model including a ground profile, the ground profile being indicative of the contours of the ground previously traversed by the work machine.

23. An automatic control system, as set forth in claim 22, wherein the control signal is further generated as a function of the ground profile.

24. An automatic control system, as set forth in claim 18, wherein the control signal is further generated as a function of a predetermined desired ground speed.

25. An automatic control system, as set forth in claim 18, further comprising a sensor operable to detect an actual condition of the material, the controller being operable to update the site model as a function of the actual condition.

26. An automatic control system, as set forth in claim 18, the controller being operable to determine an expected path of the work machine as a function of the position signal, the control signal being generated as a function of the expected path.

27. An automatic control system, as set forth in claim 18, where the data related to a condition of the material is related to hardness of the material.

28. An automatic control system, as set forth in claim 18, the controller being operable to modify a speed of the work machine as a function of the condition of the material.

29. An automatic control system, as set forth in claim 18, the controller being operable to modify a speed of the work machine as a function of the condition of the material by actuating the work implement.

30. An automatic control system, as set forth in claim 18, the slope detector includes at least one of an inclination sensor and an angular rate sensor.

31. A method for controlling a work machine operating at a work site, the work site containing material to be operated on by the work machine, including the steps of:

determining a relative location of the work machine within the work site and producing a machine position signal; and, receiving the machine position signal and determining a current condition of the material as a function of the position signal and a site model, the site model containing data related to a condition of the material.

32. A method, as set forth in claim 31, the work machine having a work implement, including the steps of:

sensing a parameter of the work implement and producing at least one implement signal;

generating a control signal as a function of the at least one implement signal and the current condition of the material; and, responsively controlling the work machine as a function of the control signal and the current condition of the material.

33. A method, as set forth in claim 31, wherein the data related to a condition of the material stored and contained in the site model is related to traction of the work machine.

34. A method, as set forth in claim 33, wherein the data related to a condition of the material includes a traction coefficient.

35. A method, as set forth in claim 34, further including the steps of:

determining a slip rate value of the work machine and responsively generating a slip signal;

determining an actual traction coefficient as a function of the slip signal; and updating the site model as a function of the actual traction coefficient.

36. A method, as set forth in claim 31, wherein the site model includes a ground profile, the ground profile being indicative of the contours of the ground previously traversed by the work machine.

37. A method, as set forth in claim 36, wherein the control signal is further generated as a function of the ground profile.

38. A method, as set forth in claim 31, wherein an implement control system includes a lift actuator associated with a work implement, the method further including the steps of:

sensing a ground speed of the work machine and responsively generating a ground speed signal;

sensing an angular rate associated with the work machine and responsively generating an angular rate signal;

determining a slip rate value of the work machine and responsively generating a slip signal;

sensing a position of the lift actuator and responsively generating a lift actuator position signal; and determining an implement position as a function of the slip signal, the angular rate signal and the lift actuator position signal, the control signal being a function of the implement position, the slip signal, and the ground speed signal.

39. A method, as set forth in claim 31, including the step of detecting an actual condition of the material and updating the site model as a function of the actual condition.

40. A method, as set forth in claim 31, including the steps of determining an expected path of the work machine as a function of the position signal, the control signal being generated as a function of the expected path.

41. A method, as set forth in claim 31, wherein the data related to a the condition of the material is related to hardness of the material.

42. A method, as set forth in claim 31, including the step of modifying a speed of the work machine as a function of the condition of the material.

43. A method, as set forth in claim 31, including the step of modifying a speed of the work machine as a function of the current condition of the material by actuating a work implement.

* * * * *

UNITED STATES PATENT AND TRADEMARK OFFICE

CERTIFICATE OF CORRECTION

PATENT NO. : 6,845,311 B1
DATED : January 18, 2005
INVENTOR(S) : Kenneth L. Stratton et al.

It is certified that error appears in the above-identified patent and that said Letters Patent is hereby corrected as shown below:

Column 14,
Line 39, delete "a"

Signed and Sealed this

Thirty-first Day of May, 2005

JON W. DUDAS
*Director of the United States Patent and Trademark Office*